United States Patent [19]

Wilkman et al.

[11] Patent Number: 4,715,305

[45] Date of Patent: Dec. 29, 1987

[54] SHIP'S HULL

[75] Inventors: Göran Wilkman, Espoo; Timo Kotilainen; Juha Pulliainen, both of Helsinki; Gustav Lindqvist, Espoo, all of Finland

[73] Assignee: Oy Wärtsilä AB, Helsinki, Finland

[21] Appl. No.: 708,970

[22] Filed: Mar. 7, 1985

[30] Foreign Application Priority Data

Mar. 12, 1984 [FI] Finland ..... 840995

[51] Int. Cl.[4] ..... B63B 35/08

[52] U.S. Cl. ..... 114/40; 114/56

[58] Field of Search ..... 114/40, 41, 42, 56

[56] References Cited

U.S. PATENT DOCUMENTS

| | | | |
|---|---|---|---|
| 3,521,591 | 7/1970 | Alexander | 114/41 |
| 3,530,814 | 9/1970 | Rastorguev et al. | 114/40 |
| 3,580,204 | 5/1971 | Burmeister et al. | 114/67 A |
| 3,985,091 | 10/1976 | Waas | 114/40 |
| 3,995,575 | 12/1976 | Jones, Jr. | 114/56 X |
| 4,351,255 | 9/1982 | Johansson et al. | 114/41 |

FOREIGN PATENT DOCUMENTS

| | | | |
|---|---|---|---|
| 2823074 | 11/1979 | Fed. Rep. of Germany | 114/40 |
| 3508787 | 9/1985 | Fed. Rep. of Germany | 114/40 |
| 629116 | 9/1978 | U.S.S.R. | 114/40 |
| 757385 | 8/1980 | U.S.S.R. | 114/40 |
| 918173 | 4/1982 | U.S.S.R. | 114/40 |
| 1009884 | 4/1983 | U.S.S.R. | 114/40 |

*Primary Examiner*—Joseph F. Peters, Jr.
*Assistant Examiner*—Paul E. Salmon
*Attorney, Agent, or Firm*—Dellett, Smith-Hill and Bedell

[57] ABSTRACT

A ship's hull has a general frame form defining a bottom surface and two side surfaces. The bottom section of the hull comprises a substantially vertical wedge-formed portion, which extends vertically downwards in the region of the lowest part of the bow portion of the hull. The bow portion follows in horizontal sections, at and below the design water line of the ship, a substantially continuous curved arc. The stem line of the bow extends downwards/rearwards in a small angle to the horizontal plane, in order to enable ice-breaking by means of bending.

19 Claims, 5 Drawing Figures

SHIP'S HULL

Figure 1:
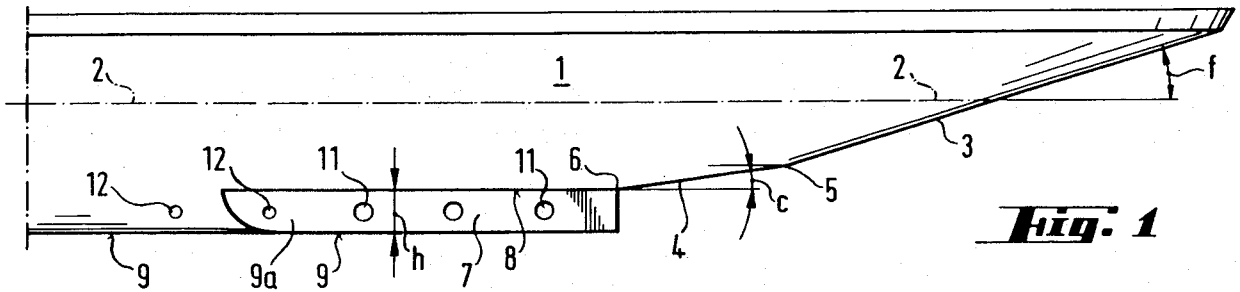

This invention relates to a ship's hull or to a ship adapted for operation in ice-filled waters.

As a ship moves through an ice field, chunks of ice in front of the ship are forced below the surface of the water by virtue of the ship's forward movement. The chunks of ice then slide along the external surface of the underwater part of the hull. Some of the chunks of ice slide along the bottom surface of the hull, thereby easily coming in contact with the ship's propeller, which reduces propeller efficiency.

The power consumption of an icebreaker is further highly dependent on the form of its bow portion. A bow portion that is broad and very much inclined downwards/rearwards, has the property of breaking ice by means of downwards bending. This has proved to be a more efficient way of ice-breaking than crushing the ice by means of a conventional V-shaped bow portion. However, flat bow portions of so called landing ship type result in quite poor seaworthiness.

The purpose of the invention is to create a favorable hull form for a ship operating in icy waters, so that chunks of ice will be directed in such a way as to have as small an adverse effect as possible on the forward movement of the ship. Another purpose is to create a bow portion form of a ship's hull the efficiency of ice-breaking of which is favorable in relation to the power consumption. The purpose is further to create such an icebreaker, the seaworthiness and manouverability of which is good.

For convenience of nomenclature, the "side surfaces" of the hull are those portions of the hull, extending downwards from the top of the hull at port and starboard respectively, which are vertical or are inclined to the vertical at a smaller angle than to the horizontal, and the "bottom surface" of the hull is that portion of the hull, beneath the side surfaces, which is inclined to the horizontal at a smaller angle than to the vertical.

The invention relates to a ship's hull or to a ship having a hull of the kind specified in the claims.

The design waterline plane of a hull is a horizontal section of the hull indicating the level of the ambient water when the ship is floating in the correct basic position in accordance with its design. The frame form of a hull is the outer contour of a cross-section of the hull.

In order to maximize the internal volume, or cubic capacity, of the ship's hull, within given overall dimensions, the hull is normally constructed so that its middle portion between the narrower bow and rear portions, is of substantially uniform beam and has a flat horizontal bottom surface, which is made as wide as possible within the limits determined by the sides of the ship.

When a ship or a hull according to the invention moves through an ice field, very few chunks of ice go under the horizontal bottom section of the hull because of the wedge-formed portion in the forward end of the horizontal bottom portion. The wedge-formed portion pushes the ice chunks to the sides of the ship, where they, owing to their buoyancy, tend to ascend to the water surface.

In a preferred embodiment of the invention, which is a ship intended for operation in extremely difficult ice conditions, the lower part of each side surface of the hull may be inclined. Further, the bow portion of the hull is preferably made somewhat broader than the adjacent portion of the hull, thereby forming a step between the bow portion and the rest of the hull. In a hull embodying the invention it is very advantageous to use the air bubbling system described in U.S. Pat. No. 3,580.204. A plurality of said air discharge openings are preferably located in the substantially vertical sides of said wedge-formed portion. The ship may also have water discharge openings in the sides of the rear part of the wedge-formed portion and/or close behind this portion. Further, the bottom of said wedge-formed portion is preferably level with and forms a continuous forward extension of the bottom portion of said hull.

In practice the wedge-formed portion extends at least substantially over the entire width of the horizontal bottom portion. The angle between the generally vertical sides of the wedge-formed portion is 30° to 90°.

The wedge-formed portion may have, in a horizontal section, slighly curved sides. The vertical height of the wedge-formed portion is 50 to 120%, preferably at least 80%, of the thickest level ice said ship is designed to break during continuous advancement through the ice. A ship according to the invention is normally designed for a thickest level ice of at least 0.5 m.

The rounded bow portion gives the hull a favorable cubic capacity, that is, the ship's internal volume is big in relation to the ship's overall dimensions. The form of the section outline at and below the design waterline plane of the bow portion has, in the central portion of said hull, a radius of curvature which is 0.4 to 2.5, preferably 0.5 to 1.5 times the beam of the hull in the same horizontal section.

The stem line of the bow portion extends obliquely from the design water line downwards/rearwards in an angle of at the most 40%, preferably at the most 18% to a horizontal plane. The more oblique stem line, the more efficient ice-breaking by means of bending. However, in order to avoid too long extension of the bow portion, said angle should not be too small, preferably it should be at least 13°.

In a preferred embodiment of the invention, the stem line of the lowest part of the oblique bow portion, that is the portion adjacent the wedge-formed portion, has an angle of inclination which is at the most 15°, preferably at the most 10° over a distance of at least 30% of the distance along the stem line from the design water line to the front end of the wedge-formed portion. This distance should be at least 3 m. Due to this feature, the velocity downwards of the chunks of ice will be lowered before they face the wedge-formed portion.

Figure 2:
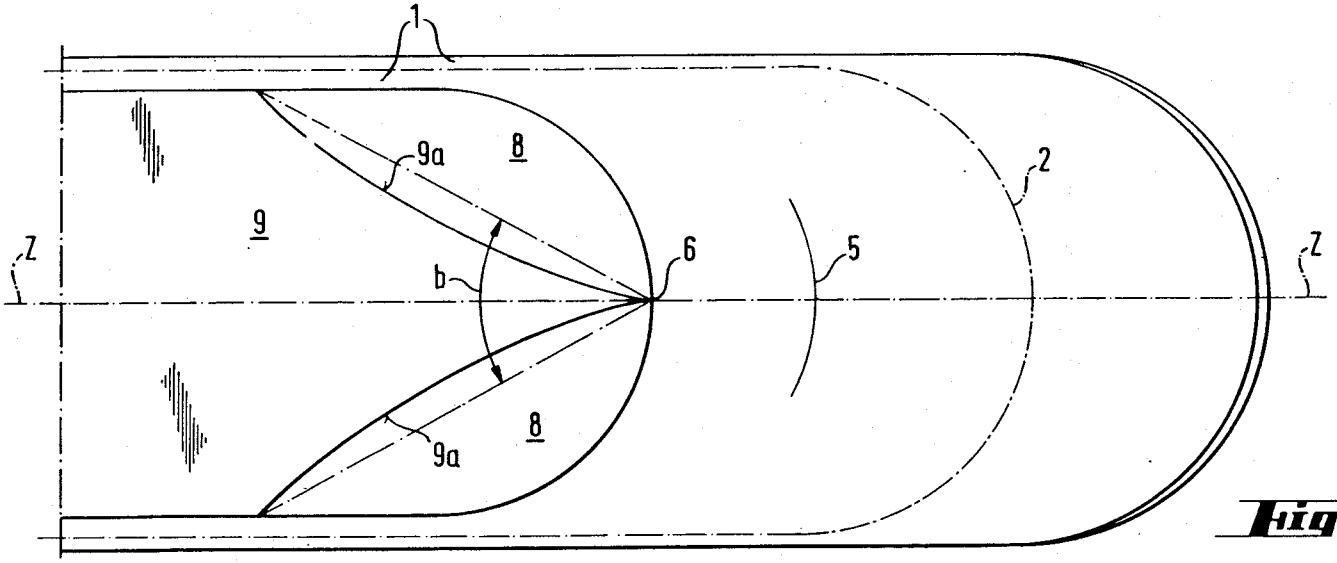
Figure 3:
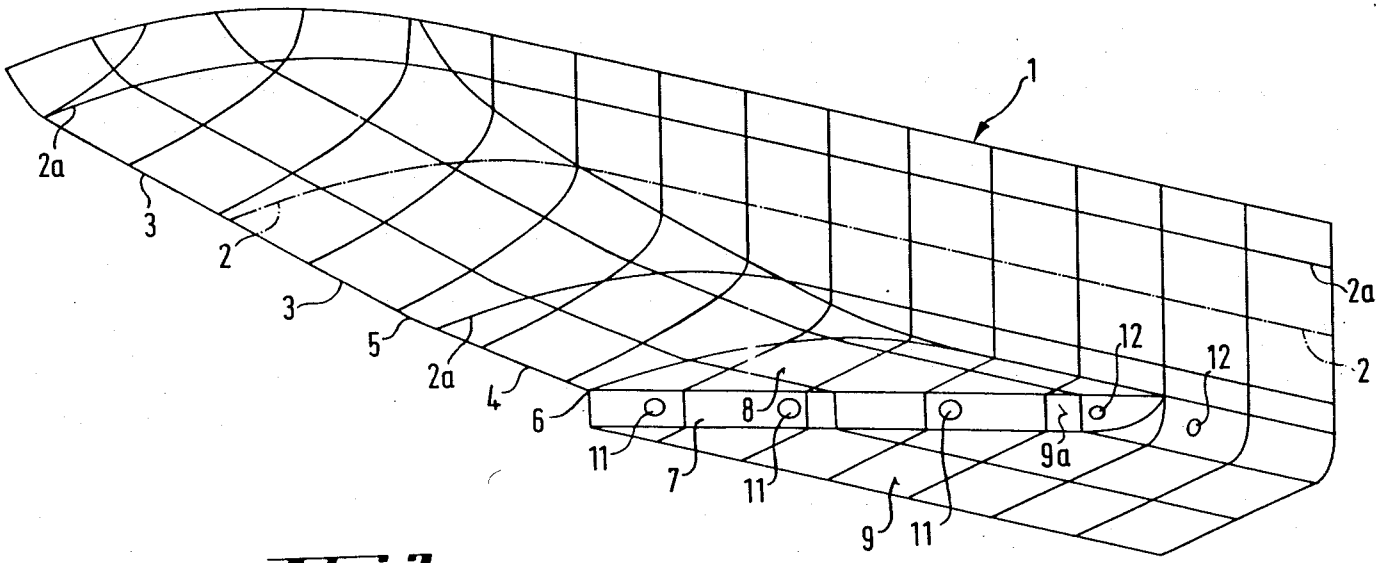
Figure 5:
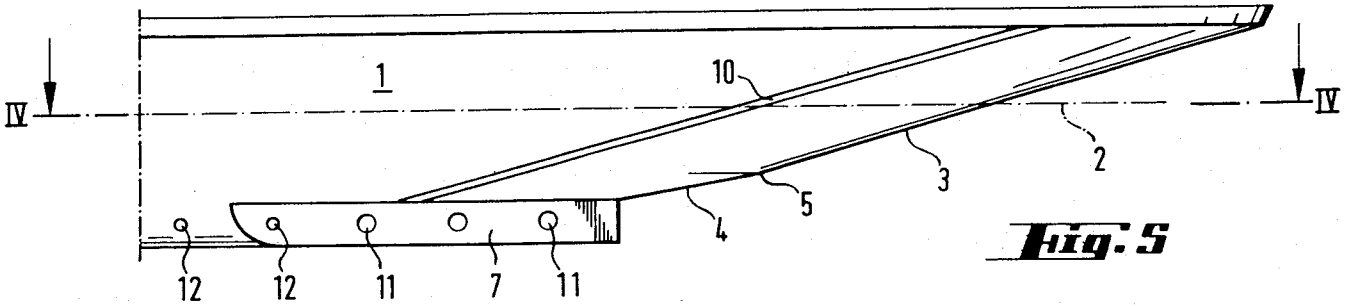
Figure 4:
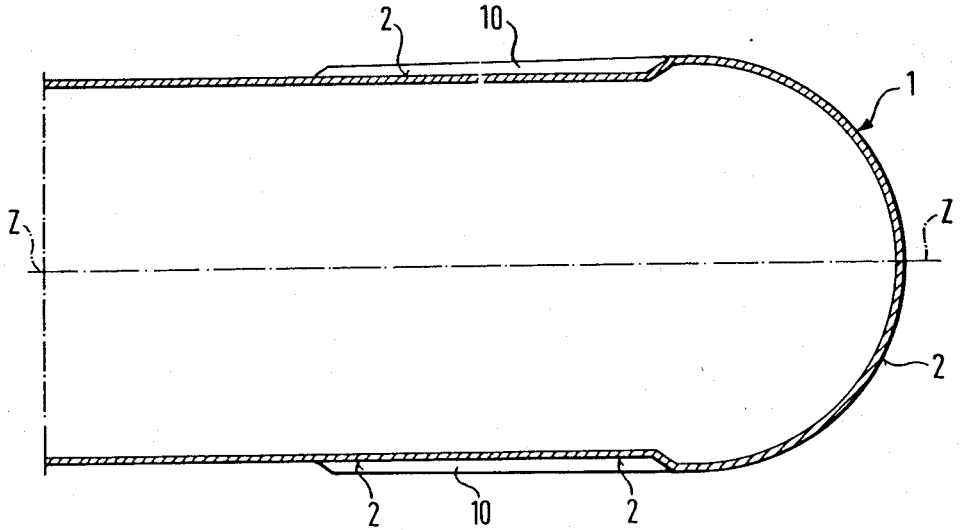

The invention will now be described, by way of example, with reference to the accompanying drawing, in which FIG. 1 is a side view of the bow portion of an embodiment of a ship's hull according to the invention, FIG. 2 is a bottom plan view of the ship's hull shown in FIG. 1, FIG. 3 is an oblique view of the left bow portion of the ship's hull shown in FIG. 1, visualized by horizontal and vertical sectional lines, FIG. 4 is a sectional view at the water line level of a bow portion of a second ship's hull, FIG. 5 is a side view of the bow portion of the ship's hull shown in FIG. 4

In the drawing, numeral 1 refers to the side surfaces of the ship's hull. Reference 2 is the design water line level, 3 is the upper part of the stem line, which part comprises the ice-breaking zone at and below the water line, 4 is the lower part of the stem line, and **2*a* are the forms of the bow portion at different horizontal sections. The side surfaces 1 are generally parallel in the longitudinal direction, and their inclination outwards/-upwards in relation to a vertical plane is preferably 0° . . . 15°. The horizontal section outlines 2, 2***a* of the bow portion are at least substantially continous curved arcs. At the bow, the radius of curvature of each arc is 0.4 . . . 2.5, preferably 0.5 . . . 1.5, times the beam of the hull in the same horizontal section. The angle f of inclination of the upper part 3 of the stem line is at most 40°, preferably not more than 18°. The upper part 3 of the stem line is connected to the lower part 4 at the junction 5. The angle c of inclination of the lower part 4 of the stem line in relation to the water line plane is at most 15°, preferably 5° . . . 10°. This change of inclination of the stem line 3,4 will lower the velocity downwards of chunks of ice before they get into contact with the side surfaces 9*a* of the wedge-formed portion 7. The junction 5 may be sharp or rounded. The rounding may cover such a large part of the stem line that the stem line 3,4 as a whole forms a continuous curved arc. However, technically it is generally favourable to build the bow portion so that the rounding of junction 5 comprises just a limited area. The length of the lower part 4 of the stem line is at least 30% of the length of the whole stem line from the water line 2 to the upper corner 6 of the front end of the wedge-formed portion 7. However, the length of said lower part 4 should be at least 3 m.

The angle b that the side surfaces 9*a* of the wedge-formed portion form between each other is 30° . . . 90°. Reference Z relates to the longitudinal, vertical symmetry plane. The side surfaces 9*a* of the wedge-formed portion may, in a horizontal section, be slightly curved. If the side surfaces 9*a* are curved inwards, the acceleration of the chunks of ice, in the transverse direction of the ship, will be more constant, which will diminish the risk of chunks reaching the bottom 9 of the ship. On the other hand, side surfaces 9*a* that are curved outwards will increase the displacement of the ship. If the side surfaces of the wedge-formed portion are curved, the mentioned angle that the side surfaces form between each other is calculated from the front end of the wedge-formed portion to the rearmost points of its side surfaces.

The side surfaces 9*a* of the wedge-formed portion are substantially vertical, and the vertical height h of the portion is 50 . . . 120%, preferably at least 80%, of the thickness of the thickest ice the ship is designed to break. The bottom part 8 of the bow portion of the ship is substantially level with the upper edge of the wedge-formed portion, and it is joined to the side surfaces 1 of the ship and, preferably by a rounding, to the upwards extending surface of the bow portion. The bottom 9 of the wedge-formed portion 7 is substantially flat-bottomed so, that said bottom forms a continous forward extension of the bottom portion of the hull.

In order to diminish the adverse effects of the ice in operating the ship, the side surfaces 9*a* of the wedge-formed portion 7 are provided with air bubbling openings 11. The water disharge openings 12 located at the rear part of the portion 7 and/or close behind that, make the removing of chunks of ice from the opened ice channel more efficient, especially in difficult conditions and at slow forward speeds.

In FIGS. 4 and 5 there is shown an embodiment of the invention, in which the bow portion is connected to the middle portion of the hull with a shoulder 10. By this arrangement the bow portion breaks a wider channel in the ice field, which diminishes friction between the middle portion of the hull and the ice field, and which makes the steering of the ship more easy.

The invention is not limited to the embodiments shown, but several modifications thereof are feasible within the scope of the attached claims. For example, it is possible to provide a ship having a conventional hull with the benefits of the present invention by connecting it, stationarily or detachably, to a barge without any propulsion mechanism of its own but having a hull in accordance with the present invention.

We claim:

1. A ship's hull that is adapted for operating an ice-filled waters and has a general frame form defining a substantially horizontal bottom surface and two opposite side surfaces, said hull having a rounded bow portion, the outline of which, in horizontal sections at and below the design waterline plane of the ship, and at least partially above the design waterline plane, is an at least substantially continuous curved arc from one side of the hull to the opposite side thereof, and said bow portion having a stem line that extends obliquely from said design waterline plane downwards in the rearward direction at an angle of at most 40 degrees to a horizontal plane, and said hull also having a wedge-shaped structure defined by two substantially vertical sides that converge in the direction from the stern of the hull towards the bow of the hull, said two sides meeting in an edge that extends substantially vertically downwards from the region of the lower end of said stem line.

2. A hull according to claim 1, wherein the two side surfaces of the general frame form are vertical.

3. A hull according to claim 1, wherein the two side surfaces of the general frame form are inclined outwards in the upward direction.

4. A hull according to claim 1, wherein the stem line extends downwards in the rearward direction at an angle of at most 18 degrees to a horizontal plane.

5. A hull according to claim 1, wherein the wedge-shaped structure has a bottom that forms a continuous forward extension of the bottom surface of the hull.

6. A hull according to claim 1, wherein the wedge-shaped structure extends over substantially the entire width of said horizontal bottom surface.

7. A hull according to claim 1, wherein the angle between the substantially vertical sides of the wedge-shaped structure is from 30 degrees to 90 degrees.

8. A hull according to claim 1, wherein the wedge-shaped structure has, in horizontal section, slightly curved sides.

9. A hull according to claim 1, wherein the vertical height of the wedge-shaped structure is 50 percent to 120 percent of the thickness of the thickest ice that a ship having the hull is designed to break.

10. A hull according to claim 9, wherein the vertical height of the wedge-shaped structure is at least 80 percent of the thickess of the thickest ice that a ship having the hull is designed to break.

11. A hull according to claim 1, wherein the outline of the bow portion of the hull, in horizontal section, has a radius of curvature at the stem of the hull which is 0.4 to 2.5 times the beam of the hull in the same horizontal section.

12. A hull according to claim 11, wherein the radius of curvature is 0.5 to 1.5 times the beam of the hull.

13. A hull according to claim 11, wherein the lower end of the stem line is inclined to the horizontal at an angle of at most 15 degrees over a distance that is at least 3 m and is at least 30 percent of the distance along the stem line from said edge to the design waterline plane.

14. A hull according to claim 13, wherein the angle of inclination is at the most 10 degrees.

15. A hull according to claim 1, wherein the bow portion of the hull is somewhat broader than the adjacent portion of the hull whereby a step is formed between the bow portion and the rest of the hull.

16. A hull according to claim 1, wherein the two substantially vertical sides of the wedge-shaped structure are formed with air discharge openings.

17. A hull according to claim 1, wherein the two substantially vertical sides of the wedge-shaped structure are formed with water discharge openings at the rearward end of those sides.

18. A hull according to claim 1, formed with water discharge openings immediately to the rear of the wedge-shaped structure.

19. A hull according to claim 2, wherein the radius of curvature of the curved arc is substantially constant from said one side of the hull, across the stem line of the bow portion, to said opposite side of the hull.

* * * * *